US005400707A

United States Patent [19]

Neider et al.

[11] Patent Number: 5,400,707

[45] Date of Patent: Mar. 28, 1995

[54] APPARATUS FOR FINISHING A CONTINUOUS SHEET OF PAPER

[75] Inventors: Thomas M. Neider, Washingtonville; Robert J. Rudt, Highland Mills, both of N.Y.

[73] Assignee: Champion International Corporation, Stamford, Conn.

[21] Appl. No.: 221,470

[22] Filed: Apr. 1, 1994

Related U.S. Application Data

[63] Continuation of Ser. No. 150,760, Nov. 10, 1993, abandoned, which is a continuation of Ser. No. 957,804, Oct. 9, 1992, abandoned.

[51] Int. Cl.[6] ..... B30B 15/34; D21G 1/00

[52] U.S. Cl. ..... 100/93 RP; 100/153; 100/162 R; 162/358.2; 428/267; 428/902; 428/909

[58] Field of Search ..... 100/93 RP, 151, 153, 100/162 R; 428/265, 267, 902, 909; 162/358.2

[56] References Cited

U.S. PATENT DOCUMENTS 3,032,441 5/1962 Beaumont et al. ..... 428/267 X
4,323,622 4/1982 Gladh et al. ..... 428/909 X
5,163,364 11/1992 Bubik et al. ..... 100/93 RP X
5,200,260 4/1993 Hsu ..... 162/358.2 X

FOREIGN PATENT DOCUMENTS 0361402 4/1990 European Pat. Off. ..... 100/93 RP
2588293 4/1987 France ..... 100/162 R

*Primary Examiner*—Stephen F. Gerrity

[57] ABSTRACT

A hot soft nip calender apparatus is provided for a paper mill. The apparatus includes at least one heated calender roller and a finishing belt which is moved in proximity to the heated calender roller by a plurality of drive rollers and at least one pressure roller. Thus, a heated calender nip is defined between the heated calender roller and the finishing belt. A web of paper is passed through the nip, such that one surface of the web of paper is contacted by the heated calender roller, while the opposed surface of the web is contacted by the finishing belt. The finishing belt has an extremely smooth surface for contacting the web of paper so as to impart appropriate smoothness and gloss characteristics to that surface. The finishing belt can readily be changed when worn or damaged or to alter the characteristics being imparted to a web of paper.

9 Claims, 2 Drawing Sheets

APPARATUS FOR FINISHING A CONTINUOUS SHEET OF PAPER

This application is a continuation of application Ser. No. 08/150,760, filed Nov. 10, 1993, now abandoned which, in turn, is a continuation of Ser. No. 07/957,804, filed Oct. 19, 1992, now abandoned.

FIELD OF THE INVENTION

The subject invention relates generally to hot soft nip calendering for producing a smooth and/or glossy finish on at least one surface of a sheet of paper.

BACKGROUND OF THE INVENTION

Paper mills transport a continuous web of paper through a complex array of rolls. Selected rolls in the paper mill are arranged in pairs and define a nip therebetween. Temperature, pressure, rotational speed and surface characteristics of the rolls determine the characteristics of the paper produced in the paper mill.

Many papers are required to have a smooth and/or glossy surface on at least one side. Hot soft nip calendering using a pair of specially covered rolls is commonly used in the prior art to impart a smooth or glossy finish to a surface of the paper being produced in the prior art paper mill. A prior art hot soft nip calender apparatus is identified generally by the numeral 100 in FIG. 1 and includes a pair of oppositely rotating rolls 102 and 104 defining a nip 106 therebetween. The roll 102 typically is formed from a metallic material, such as steel, and is a complex structure with passages 108 extending therethrough. A hot oil is circulated through the passages to heat the outer surface 110 of the roll 102. A temperature of 400° F. often will be achieved in the nip 106. Other prior art rolls, however, are gas fired and may attain surface temperatures above 500° F. The roll 104 in the prior art hot soft nip calender apparatus 100 includes a metallic shell 112 with a smooth soft outer cover 114 securely engaged or laminated thereon. The rolls 102 and 104 typically are disposed relative to one another to achieve an operating pressure on a paper web 116 therebetween in the range of 1,000–3,000 pounds per linear inch.

The high speed, high temperature and high pressure employed in the prior art hot soft nip calender apparatus 100 create a potential for failure of the cover 114 on the roll 104. In particular, the cover 114 is known to delaminate from the metallic shell 112 to which the cover 114 is initially affixed. A replacement roll often will cost in the range of $300,000– $400,000 and an additional expensive roll must be maintained in inventory. This high cost is due to the complicated lamination of the cover 114 to the shell 112 in an effort to achieve a soft surface that will withstand the high speeds, high pressures and high temperatures used in the prior art calender apparatus 100 described above. The delaminated cover 114 also can damage downstream equipment in the paper mill. Thus, the total cost for such a failure can exceed the significant cost of the soft calender roll 104 itself. Furthermore, the down-time for the paper mill can represent a substantial cost penalty independent of the replacement cost for the damaged roll.

Some aspects of paper finishing processes could be enhanced by using higher temperatures and/or pressure in the hot soft nip calender. For example, it often would be desireable to operate some such calenders at pressures approaching 2000 pounds per linear inch. It also would be desirable to achieve nip operating temperatures significantly higher than 400° F. However, these higher pressures and temperatures would exacerbate the problems of delamination of the soft cover 114 from the shell 112 of the prior art apparatus 100.

In view of the above, it is an object of the subject invention to provide an improved hot soft nip calender.

It is another object of the subject invention to provide a hot soft nip calender where the soft smooth material of the nip can be substantially reduced in cost.

A further object of the subject invention is to provide a hot soft nip calender which enables higher operating temperatures and pressures in the nip.

An additional object of the subject invention is to provide an efficient hot soft nip calendering process.

SUMMARY OF THE INVENTION

The subject invention is directed to a hot soft nip calender apparatus which includes an elongated continuous belt of a suitably soft, smooth and strong material. The belt may include a substrate made by a textile weaving process. The substrate may be formed from Kevlar (DuPont), PEEK (DuPont), Ryton (Phillips), polyester or other such material known for its strength and high temperature capabilities. An exceptionally smooth outer layer is provided on the surface of the belt that will contact the paper. The smooth outer layer may comprise rubber, urethane or other such elastomeric material, as well as metallic materials that will perform well and maintain its characteristics after long term exposure to high temperature and pressure. The required degree of smoothness for the outer layer may be achieved by mechanical means including, but not limited to continuous casting, molding, extruding, metallizing, grinding and other precision machining processes. The opposed inner surface of the belt may be defined by the substrate, and may have a surface configuration to promote cooling or ventilation. The various layers of the belt are assembled by coating, lamination, needling or other such known process. The continuous loop of the belt preferably has a length selected to permit some cooling of the belt between successive passes through a nip as explained herein. For example, the belt may define a total length of approximately 35–90 feet, and preferably 35–50 feet.

The belt is removably mounted on an array of parallel belt carrier rolls. The belt carrier rolls are disposed to engage the inner surface of the belt and to circumferentially carry, support, tension and guide the belt.

The apparatus of the subject invention may further include a heated roll aligned parallel to the belt drive rolls and substantially adjacent the outer surface of the belt. The heated roll may be heated by hot oil, gas fired heaters or other such heating means.

The hot soft nip calender apparatus further includes pressure means adjacent the inner surface of the belt for urging the outer surface of the belt toward the heated roll and to define a nip therebetween. The pressure means may be adjustly mounted for exerting a pressure of approximately 1000–3000 pounds per linear inch on the belt in the nip. The pressure means may be defined by one of the belt drive rolls. Alternatively, the pressure means may be a non-rotating structure such as a pressure shoe. The dwell time of the paper passing through the nip can be extended substantially by having a pressure shoe defining essentially a line of contact through the nip. Alternatively, the nip can be extended by having several belt carrier rolls disposed circumferentially around the heated roll of the calender apparatus. Thus, the paper web will traverse a portion of the circumference of the heated roll. Hot soft nip calenders in accordance with the subject invention also may be used in tandem to alternately finish opposed surfaces of a web of paper.

The hot soft nip belt calender of the subject invention has several significant advantages over the prior art. First, the costly lamination of a cover onto a shell is entirely avoided. Thus, although a greater amount of the soft material is required for the belt than for the cover, the total cost of the belt is a fraction of the cost of having the roll recovered or the cost of a spare roll. The belt of the subject hot soft nip calender also allows for cooling of the belt material between successive passes of the belt through the nip. This periodic cooling contributes to a longer belt life and enables higher local temperatures and pressures to be employed in the nip. Additionally, the subject calender belt can be replaced readily in the event of damage or wear, or to achieve different surface characteristics for the paper being manufactured.

DETAILED DESCRIPTION OF THE PREFERRED EMBODIMENT

Figure 2:
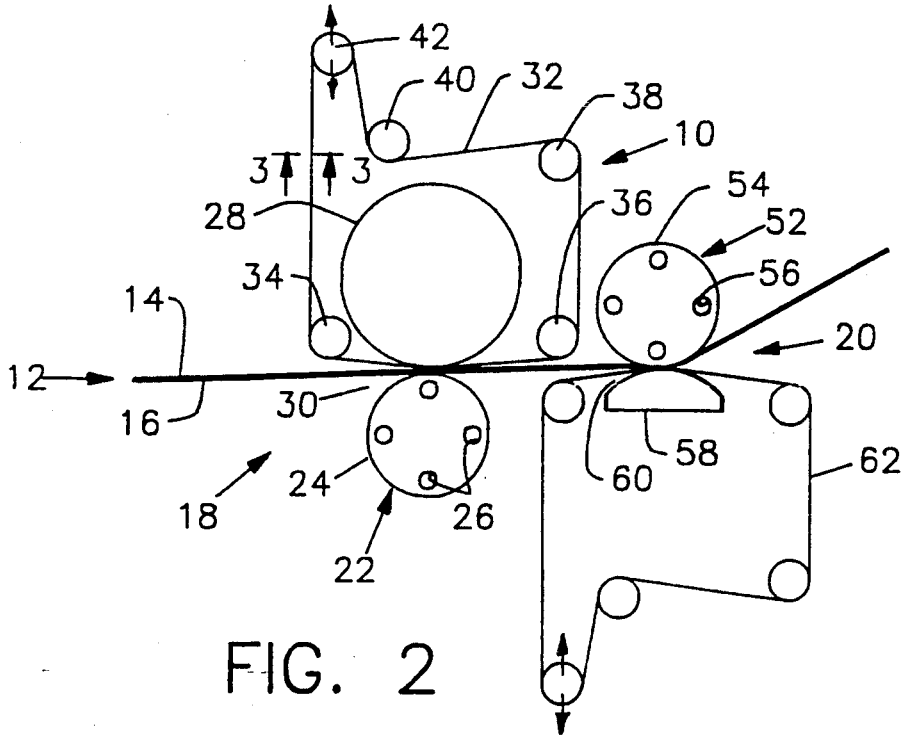
FIG. 2 is a schematic side elevational view of a hot soft nip calender in accordance with the subject invention.

A hot soft nip calender apparatus in accordance with the subject invention is identified generally by the numeral 10 in FIG. 2. The calender apparatus 10 is part of a paper mill which produces a continuous web of paper 12 having opposed first and second surfaces 14 and 16 respectively. The calender apparatus 10 includes first and second calendering stations 18 and 20 which operate in tandem to impart smooth and/or glossy finishes to the respective first and second surfaces 14 and 16 of the paper web 12. The first and second calendering stations 18 and 20 are shown as being slightly different from one another to achieve different finish characteristics for the surfaces 14 and 16 of the sheet of paper 12. In some instances, however, the first and second calendering stations may be structurally and functionally substantially identical except for their respective orientation relative to the web of paper 12 passing therethrough. In other instances only one calendering station 18 or 20 may be provided to yield a sheet of paper 12 having only the first or the second surface 14 or 16 with a smooth or glossy finish.

The first calendering station 18 of the apparatus 10 includes a heated calender roll 22 having a stainless steel outer surface 24 and a plurality of passages 26 extending therethrough in proximity to the outer surface 24. The passages 26 in the heated calender roll 22 are operative to carry a hot oil for elevating the temperature of the external surface 24 to at least approximately 400°–550° F.

The first calender station 18 further includes a pressure roll 28 in opposed parallel relationship to the heated calender roll 22 and defining a nip 30 therebetween. The rolls 22 and 28 serve as the drive means.

A continuous finishing belt 32 is mounted on carrier rolls 34–42 and passes through the nip 30 between the heated calender roll 22 and the pressure roll 28. The roll 42 is movable, as shown by the arrows in FIG. 2, to adjust the stretch or tension of the belt 32. The web of paper 12 also passes through the nip 30 such that the first surface 14 of the web 12 is ,engaged by the finishing belt 32. The pressure roll 28 is adjustably mounted at the first calendering station 18 to achieve a pressure on the first surface 14 of the paper web 12 preferably in the range of about 1000–3000 pounds per linear inch.

Figure 3:
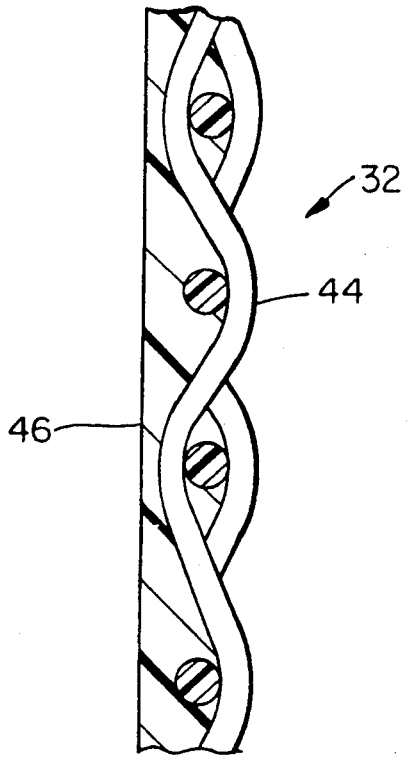
FIG. 3 is a cross-sectional view taken along line 3—3 in FIG. 2.

As shown in FIG. 3, the finishing belt 32 preferably comprises a woven substrate 44 formed from a strong flexible synthetic material that can withstand long term exposure to high temperatures and pressures, such as Kevlar, PEEK, Ryton or polyester. The belt 32 further includes a finishing surface 46 formed from a flexible elastomeric material that also will perform well after long term exposure to high temperatures and pressure. Suitable materials include rubber and urethane finished to a high degree of smoothness (e.g. 50 micro inch smoothness.) The exact degree of smoothness and the relative softness of the finish surface 46 will be selected in accordance with the desired finish characteristics, such as gloss or matte finishes, on the first side 14 of the paper web 12. The belt 32 may further be provided with a backing layer on the side of the substrate 44 opposite the finishing surface 46. The backing layer, if provided, could include surface configurations that will enhance cooling by conducting or dispersing heat away from the nip 30. The belt 32 preferably defines a length of approximately 35–50 feet extending around the rollers 34–42. This length is within the capabilities that can be manufactured efficiently by known continuous belt technology. Furthermore, the 35–50 foot length enables ample cooling of the belt 32 between successive passes through the nip 30 and in proximity to the heated calender roll 22.

The second calendering station 20 is similar to the first calendering station 18, but is oppositely oriented relative to the web of paper 12. In particular, the second calendering station 20 is oriented to impart a smooth and/or glossy or matte finish to the second side 16 of the paper web 12. Briefly, the second calendering station 20, as shown in FIG. 2, includes a heated calender roll 52 having an outer cylindrical surface 54. A plurality of passages 56 extend in proximity to the outer surface 54 and circulate a heated oil for heating the outer surface 54 of the heated calender roll 52. The second calendering station 20, in this embodiment does not include a pressure roll, but rather has a non-rotating pressure shoe 58. The pressure shoe 58 is dimensioned and configured to provide a longer or extended nip 60 which will achieve a longer dwell time for the paper web 12 in the nip 60. A finishing belt 62, which may be similar to the finishing belt 32 passes through the extended nip 60 such that the smooth finishing surface of the second belt 62 engages the second face 16 of the web of paper 12.

It will be appreciated that the hot soft nip calender apparatus 10 depicted in FIG. 2 is operative to impart a smooth and/or glossy finish to both opposed surfaces 14 and 16 of the web of paper 12. In some instances, however, only one surface of a web of paper is required to have a smooth and/or glossy finish. In these instances, only one of the hot soft nip calendering stations 18 or 20 need be provided. In other situations, the finished characteristics of the opposed surfaces 14 and 16 of the web 12 should be identical. Thus, in these situations the first and second calendering stations 18 and 20 may be the same. In each possible embodiment, the temperature imparted by the heated calender roll 22, 52 and/or the pressure imparted by the pressure roll 28, 58 or pressure shoe 58 are selected to achieve specified finish characteristics for the paper 12. Additionally, the calendering stations 18 and 20 may be provided with finishing belts 32, 62 that differ from one another in smoothness and/or softness to impart different surface characteristics to the paper 12.

Figure 4:
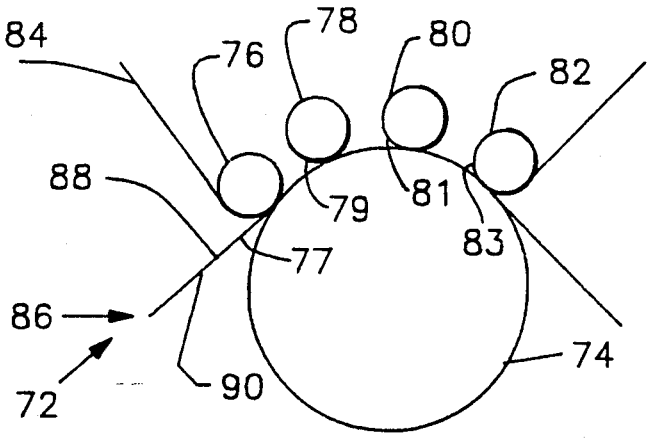
FIG. 4 is a schematic side elevational view of an alternate hot soft nip calender in accordance with the subject invention.

As noted above, the surface characteristics imparted by the calender apparatus are determined by the temperature and pressure imparted to the paper, the smoothness and softness of the finishing belt and the dwell time in the calendering nip. FIG. 4 shows an apparatus in accordance with the subject invention where the dwell time in the nip is substantially increased beyond that provided in the FIG. 2 embodiments. In particular, a third calendering station 72 includes a heated calender roll 74 in combination with carrier rolls 76, 78, 80 and 82 to define nips 77, 79, 81 and 83 respectively. A finishing belt 84, as described above, passes through the respective nips 77, 79, 81 and 83. A web of paper 86 having opposed first and second surfaces 88 and 90 passes through the nips 77, 79, 81 and 83, such that first surface 88 of the web 86 is in direct contact with the smooth surface of the finishing belt 84. In this manner, the first surface 88 of the web 86 is successively exposed to the calendering nips 77, 79, 81 and 83 to have a longer dwell time for exposure to the high temperature and pressure of the calendering nips 77, 79, 81 and 83 with a corresponding effect on the quality of the finished paper.

Figure 1:
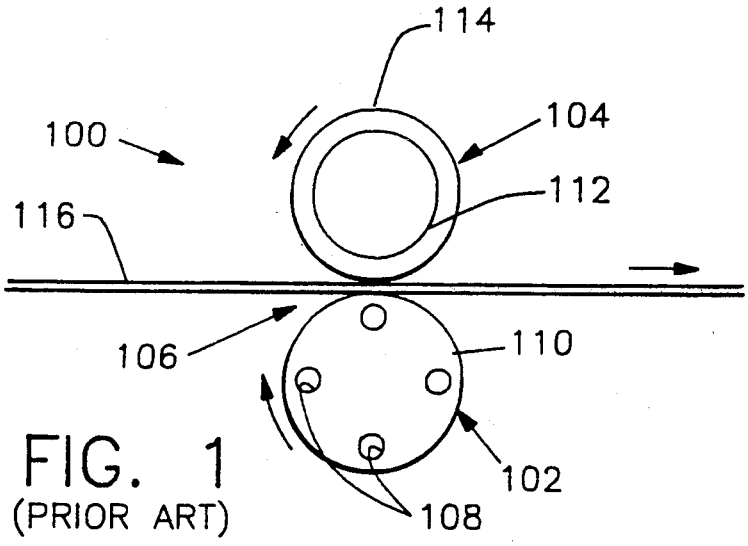
FIG. 1 (PRIOR ART)
FIG. 1 is a schematic side elevational view of a prior art hot soft nip calender.

The apparatus shown in FIG. 4 provides substantially the same advantages of the apparatus 10 shown in FIG. 2. In particular, the finishing belt 84 can readily be replaced when worn or damaged, or to achieve different paper finish characteristics without a remanufacture of a covered roll as had been the case with the prior art of FIG. 1. Additionally, the finishing belt 84 has substantial time between successive exposures to the heated calender roll 74 for cooling.

In summary, a hot soft nip calender apparatus and process is provided employing a heated calender roll and an elongated finishing belt. The finishing belt is driven by a plurality of carrier rollers and at least one pressure means disposed in proximity to the heated calender roll. Thus, a nip is defined between the finishing belt and the heated calender roll through which a web of paper can be directed. The finishing belt is provided with a flexible and strong substrate that can perform well in response to long term exposure to high temperatures. The finishing belt further includes a finishing layer applied to the substrate and disposed for direct contact with the web of paper. The finishing layer has softness and smoothness characteristics for imparting an appropriate finish to the paper. Calender apparatus of the subject invention may be used in tandem to sequentially apply appropriate finishes to opposed surfaces of the paper web. The apparatus may further be provided with a plurality of pressure rolls disposed circumferentially relative to the heated calender roll or with one or more pressure shoes for effectively extending the nip area to which the paper is subjected.

While the invention has been described with respect to certain preferred embodiments, it is apparent that various changes can be made without departing from the scope of the invention as defined by the appended claims. For example, other optional constructions for the finishing belt may be provided in accordance with the heat, pressure and speed of operation for the particular calender apparatus, and further in accordance with the desired finish characteristics for the paper. Additionally, other roller and nip constructions may be provided to achieve the desired dwell time within the nip and the optimum time between successive passages of the web through the nip.

We claim:

1. A hot soft nip calendar apparatus comprising:

a plurality of substantially parallel belt carrier rolls;

a continuous belt surrounding said belt carrier rolls, said belt having an inner surface facing said belt carrier rolls and an outer finishing surface facing away from said belt carrier rolls;

said continuous belt comprising a substrate including the inner surface formed from a woven flexible synthetic material and the outer finishing surface formed from a smooth soft material capable of withstanding temperatures of at least about 400° F.;

a calender roll parallel to said belt carrier rolls disposed substantially adjacent said outer finishing surface of the belt and in proximity to at least one said belt carrier roll, such that a calender nip is defined intermediate the calender roll and the belt for receiving a web of material there between; and a means for heating said calender roll to achieve a temperature of at least about 400° F. in said nip.

2. An apparatus as in claim 1, wherein the outer finishing surface of the belt defines a smoothness of 50 micro inch.

3. An apparatus as in claim 1, wherein the outer finishing surface of the belt is formed from a smooth elastomeric material.

4. An apparatus as in claim 1, wherein the inner surface of the belt has a configuration for promoting heat transfer from the belt after passage of the belt through the nip.

5. An apparatus as in claim 1, wherein a plurality of the belt carrier rolls are disposed circumferentially about the heated calender roll such that a plurality of calender nips are defined intermediate the heated calender roll and the continuous belt for receiving a web of material therebetween.

6. A hot soft nip calender apparatus comprising:

a plurality of substantially parallel belt carrier rolls;

a continuous belt surrounding said belt carrier rolls, said belt having an inner surface adjacent the belt carrier rolls and an outer surface facing away from the belt carrier rolls;

said continuous belt comprising a substrate including the inner surface formed from a woven flexible synthetic material and a finishing layer forming said outer surface formed from a smooth soft material capable of withstanding temperatures of from about 400° F. to about 550° F.;

pressure application means disposed adjacent the inner surface of the belt;

a calender roll extending parallel to the belt carrier rolls and substantially adjacent the outer stirface of the belt at a location in proximity to the pressure application means, such that a calender nip is defined between the calender roll and the outside stirface of the belt in proximity to the pressure application means; and a means for heating said calender roll to achieve a temperature of from about 400° F. To about 550° F.

7. An apparatus as in claim 6, wherein the pressure application means defines a non-rotating shoe adjustably mounted for urging the belt against the heated calender roll, the shoe being configured to define an extended nip intermediate the heated calender roll and the belt for providing an extended dwell time for a web of material passing through the nip.

8. An apparatus as in claim 6, wherein the pressure application means defines at least one roll adjustably mounted for urging the belt against the heated calender roll.

9. An apparatus as in claim 6, wherein the pressure application means is adjustably mounted for exerting a pressure of approximately 1000–3000 pounds per linear inch on the belt in the nip.

* * * * *